United States Patent [19]

Zemke, deceased et al.

[11] Patent Number: 4,604,849

[45] Date of Patent: Aug. 12, 1986

[54] INSERTION MACHINE DRIVE

[75] Inventors: Edward H. Zemke, deceased, late of Chicago, Ill., by Anne Zemke, legal representative; Kenneth L. Guenther, Park Ridge, Ill.; Gerald D. Warden, Easton, Pa.

[73] Assignee: Bell & Howell, Chicago, Ill.

[21] Appl. No.: 648,640

[22] Filed: Sep. 7, 1984

[51] Int. Cl.[4] ..... B65B 43/30; B65H 29/12

[52] U.S. Cl. ..... 53/266 A; 474/113; 53/250

[58] Field of Search ..... 53/266 A, 206, 457, 53/459, 460, 469, 473, 249, 250; 74/665 GE; 474/113

[56] References Cited

U.S. PATENT DOCUMENTS

| | | | |
|---|---|---|---|
| 1,317,387 | 9/1919 | Penney et al. | 53/266 A |
| 1,886,525 | 11/1932 | Cottrell, III | 493/34 |
| 2,325,455 | 7/1943 | Williams | 53/266 A X |
| 2,808,693 | 10/1957 | Guggenheim | 493/476 X |
| 3,185,078 | 5/1965 | McGregor et al. | 74/665 GE X |
| 3,368,321 | 2/1968 | Sather et al. | 53/266 A X |
| 3,583,124 | 6/1971 | Morrison | 53/381 R X |
| 3,650,527 | 3/1972 | Helm | 493/478 X |
| 3,965,644 | 6/1976 | Stocker | 53/266 A X |
| 4,418,515 | 12/1983 | Foster et al. | 53/266 A X |

*Primary Examiner*—James F. Coan

*Attorney, Agent, or Firm*—Laff, Whitesel, Conte & Saret

[57] ABSTRACT

An insertion machine has a stationary table for holding inserts, and a linearly movable table for receiving and holding envelopes. The moving table jogs left or right to align the insert and envelope so that the insert may be pushed into the envelope. A parallelogram drive mechanism has a first pair of belt drives which form vertical parallel arms. As the table moves back and forth, the length of the parallel vertical drive mechanism does not change appreciably so that the ends of the vertical arms float up and down. There is no need for sliding gears, shafts, or the like to transfer power to the table. A second pair of belts drive the vertical belts from a stationary point at a center of the side of the parallelogram which is opposite the table. The second pair of drive belts enables the lower ends of the first pair of drive belts to float up or down slightly without causing any dislocation as a result of table movement.

22 Claims, 8 Drawing Figures

INSERTION MACHINE DRIVE

This invention relates to insertion machines, and more particularly, to means for automatically inserting papers, cards, advertisements, or the like ("inserts") into envelopes.

U.S. Pat. Nos. 2,325,455; 3,368,321; 3,583,124; and 3,965,644 provide four examples of insertion machines which have been used in the past.

An example of an insertion machine is one which is able to pick up a number of different inserts, hold open an envelope, push the inserts inside the open envelope, and then close and pass the filled envelope onto the next work station, perhaps to an envelope sealer and a postage meter. The insertion function is a rather complex one because the inserts do not always have a uniform size. For example, one insert may be a short postcard, another a medium length folded advertisement perhaps approaching the thickness of a small booklet, yet another a sample of merchandise in a sealed plastic envelope, and still another a computer printed bill with an address which must show through a window on an envelope. The envelopes used for mailing one stack of inserts may be long and narrow while those used for mailing another stack of inserts may be short and wide. In addition, envelopes are constructed of different materials, and the construction of the envelopes may vary. Thus, an insertion machine should be capable of aligning the many forms and compositions of inserts and envelopes in a manner which may be changed between successive mailings.

Presently available insertion machines for so aligning the inserts and envelopes are relatively large, complicated, and noisy devices. It is necessary to mechanically adjust a table mechanism carrying either an envelope or an insert relative to a stationary table carrying the other. This presents a problem of supplying synchronized power from a single source to the two tables since it would be too expensive to provide completely separate and duplicated power supplies. Heretofore, power has been transferred via a complex series of shafts and gears. As the table mechanism is adjusted, the gears have had to slide on the shafts, or the shafts have had to move relative to other shafts.

Accordingly, an object of the invention is to provide new and improved automatic insertion machines. Here, an object is to provide a quieter, more reliable, and lower cost insertion machine.

Another object is to provide a single power source which can transfer power to two parts which experience movement relative to each other, without loss of synchronization.

In keeping with an aspect of the invention, these and other objects are accomplished on an insertion machine having a linearly adjustable table mechanism for receiving and holding the envelopes and a stationary table mechanism for delivering inserts to the envelopes. The moving table mechanism forms the top side of a parallelogram power drive mechanism which has two dependent belt drives on either end of the table mechanism forming the approximately vertical arms of the parallelogram. As the table mechanism is adjusted back and forth, a lower, partially floating end of each of the vertical belt mechanisms raises and lowers. Two additional belts drive these lower, partially floating ends of the vertical belt mechanisms, power being supplied to the second belts from a stationary point of a bottom side of the parallelogram drive mechanism. The lower ends of the first pair of drive belt mechanisms are able to move up and down because the change in center distance between the fixed pulley and the lower-end pulley of each belt mechanism is relatively small over the adjustment range required.

One vertical belt, which is driven by one of the horizontally extending belts, is driven intermittenly, while the second vertical belt is driven at a continuous speed by its associated horizontal drive belt. A synchronized relationship exists between the intermittent drive and the continuous speed drive, and it is a primary purpose of the parallelogram drive mechanism of the present invention to insure that this synchronized relationship is maintained throughout the adjustment range of the table mechanism.

In this description, the terms "drive belts" or "drive chains" are to be construed broadly enough to cover either of these or equivalents thereof, such as belts with involute teeth. Likewise, either pulley wheels or sprocket wheels (or the equivalent) may be used, depending upon what is appropriate for the drive belt or chain that is used.

A preferred embodiment for accomplishing these and other objects is shown in the accompanying drawings, wherein.

Figure 1:
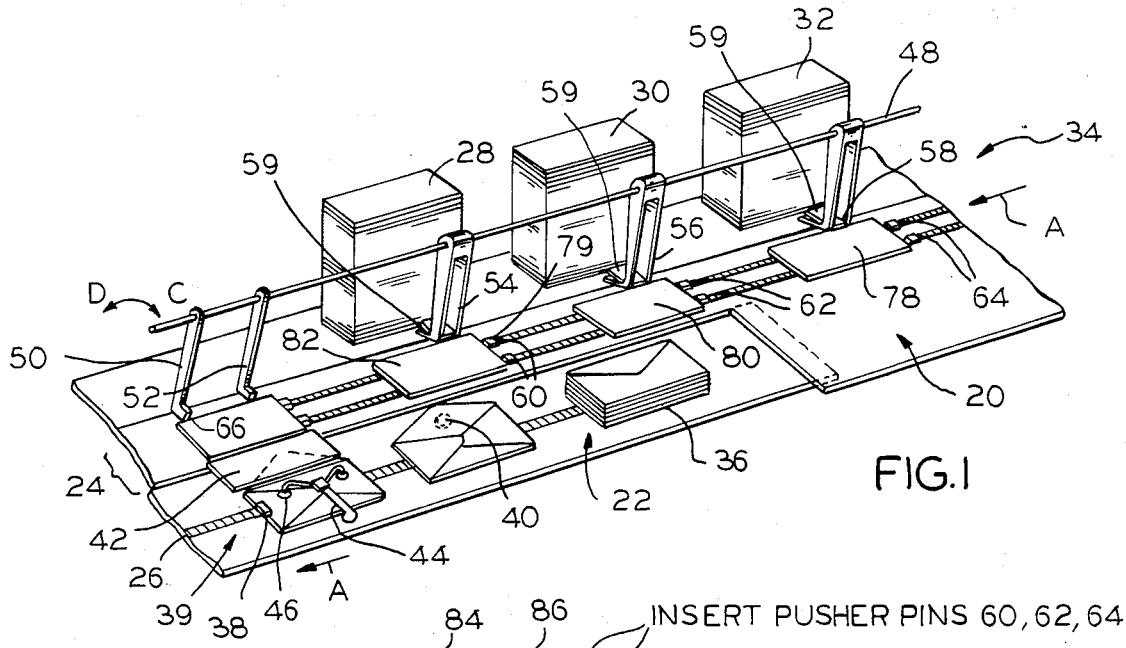
FIG. 1 is a perspective view of the pertinent parts of an insertion machine which may incorporate the invention.

FIG. 1 presents the top and superstructure of an insertion machine which is somewhat similar to that shown in U.S. Pat. No. 3,965,644. This part of the machine is shown in order to explain the need for the invention.

The major elements in FIG. 1 are a fixed or stationary table 20, a horizontally movable table 22, two chain drives 24, 26, three magazines 28, 30, 32 filled with inserts, and insert pick up and stuffing pusher mechanism 34.

A stack 36 of envelopes is positioned on front or movable table 22 at a location where envelopes may be pulled from the bottom of the stack by a continuously operating feeder mechanism (not shown) and then deposited on an intermittently operating chain drive 26 which carries the envelope to a stuffing location 39. A number of grippers 38 are attached to the envelope drive chain 26 at periodic locations. Thus, for example, if the grippers 38 are separated by 20-inches of chain, one of the envelopes is picked up from the stack 36 everytime that 20-inches of chain moves under the stack.

As the chain 26 intermittently moves an envelope in direction A to stuffing position 39, the envelope flap is opened by a rotating suction cup assembly 40, which holds the envelope flap in a captured or hold down position. The chain 26 then moves the envelope to its correct stuffing position, where its flap is held down by means of a plate 42 under which the flap extends. Then a pivoted arm 44 moves downward where vacuum sucker cups 46 attach themselves to the back side of the envelope. Next, the pivoted arm 44 raises the sucker cups 46 to hold open one side of the envelope, the flap being held down by plate 42.

Any suitable number of magazines (here three 28, 30, 32) may be mounted on the rear or stationary table 20, along a line confronting the envelope drive chain 26. There is one magazine for each insert that is to be placed in the envelope. A pair of chains 24 move intermittently in front of the magazines to carry the inserts to an area directly adjacent stuffing position 39.

A continuously driven, common rotating rod or bar 48 extends parallel to and in front of the magazines 28, 30, 32. Attached to and extending downward from rod 48 are a number of kickers 50, 52 and pick up bars 54–58. As the rod 48 rotates in the directions C, D, each of the pick up bars 54–58 includes a gripper 59 which pulls one insert from the bottom of each magazine and positions it on top of stationary table 20, directly above a pair of slots in which chains 24 are moving. Pushers such as 60, 62, 64 are positioned on and secured to each of the insert transport chains 24, the spacing between pushers being approximately equal to the spacing between the magazines. The locations of the pushers 60–64 on the chains 24 are coordinated to position the inserts at position 66 immediately in front of the open envelope in the stuffing position 39. Therefore, when the rod 48 rotates in direction D, kicker bars 50, 52 move forward and push the inserts from position 66 into the envelope.

As chains 24 move in direction A, rod 48 rotates in direction C (FIG. 1). Pick up arm 58 picks up an insert from the bottom of magazine 32 and drops it at position 78. The pushers 64 engage the trailing edge of the insert and chain 24 carries that insert to a position 80. The next time that rod 48 rotates, pick up 56 pulls an insert from magazine 30 and drops it on top of the one that was pulled from magazine 32 at position 80. As the chains 24 continue to move the inserts, they reach position 82. When rod 48 next rotates, pick up 54 pulls an insert from the bottom of magazine 28 and drops it on top of the two inserts previously taken from magazines 30, 32. At the same time, inserts are also being constantly dropped at locations 78 and 80, and the cycle of operation is continuous.

When the stack of inserts reaches the stuffing station 66, pushers 60, 62, 64 are pulled below the top level of stationary table 20 by the action of chains 24, thereby depositing the stack of inserts at stuffing station 66. Kickers 50, 52 push the stationary inserts over plate 42 and into the envelope being held open by the suckers 46. Thereafter, the suction is released from the vacuum cup suckers 46 and chain 26 moves the stuffed envelope to any other suitable station, such as a sealer and a postage meter, for example.

It should be noted that many of the structures described above require both intermittent and continuous power on both the fixed or stationary table 20 and the movable table 22. There is no problem for a stationary power source to supply the power to move insert chains 24, rod 48, parts of the pick ups 54–58, and kickers 50, 52, for example, because they are on fixed and stationary table 20. A simple belt drive will supply that power. However, it is difficult to supply power from intermittent and stationary power sources and obtain mechanical synchronization between all moving parts such as envelope chain 26, gripper 38, arm 44, etc., because those parts are on moving table 22, and are moving in different sequences. It is important in an insertion machine of the type described that all intermittently and continuously driven parts remain in complete synchronization throughout the full range of operation and adjustment of each moving element. The present invention provides such mechanical synchronization in a low cost, quiet, and simple manner.

Figure 2:
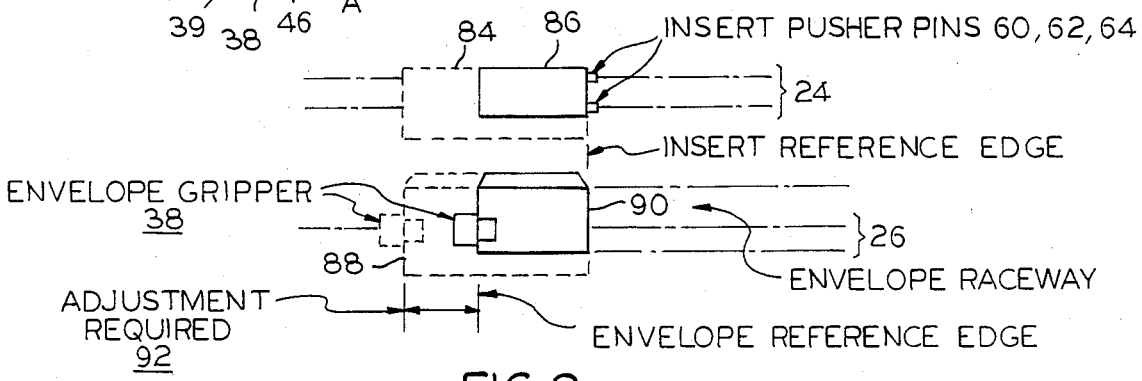
FIG. 2 is a schematic graphical representation of envelopes and inserts which illustrate a problem which the invention solves.

The need for both a movable and a stationary table for the insertion machine of FIG. 1 is explained with the help of FIG. 2. The pusher pins 60, 62, 64 are separated by distances on chains 24 which are coordinated with the positions of magazines 28, 30, 32. Inserts are prepared at various lengths, some long, as shown by dashed lines at 84; and some short, as shown by solid lines at 86. The envelopes in stack 36 are supplied at various lengths (long as at 88; short as at 90), and it is important that the size of the envelope be coordinated with the size of the longest of the inserts.

Adjustment of table 22 in the horizontal plane is necessary since the inserts are pushed at their trailing edges by pushers 60, 62, 64, while the envelopes are pulled at their leading edges by gripper 38. This is the most desirable way of operating the subject insertion machine, because if the inserts were pulled, the gripping mechanism used to pull them would be opened for each insert, which presents a high probability of jamming as each consecutive insert is fed into each gripping mechanism. To eliminate this problem, the inserts are pushed. Envelopes, on the other hand, require the flap to be opened during movement from the stack 36 to stuffing position 39, which necessitates that the envelopes be pulled. Thus, all of the trailing edges of the stack of inserts are aligned by pushers 60, 62, 64 while the leading edges of the envelopes are brought to a position defined by the stopped position of gripper 38. This means that the position of the envelope gripper 38 must be adjusted, as indicated at 92, so that long inserts may be placed in long envelopes and short inserts may be placed in short envelopes.

Figure 3A:
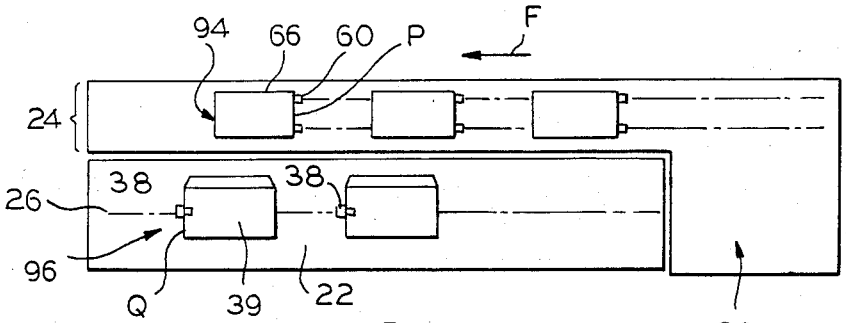
FIGS. 3A and 3B is a plan view of the tops of stationary and moving tables which schematically show the operation of the insertion machine.
Figure 3B:
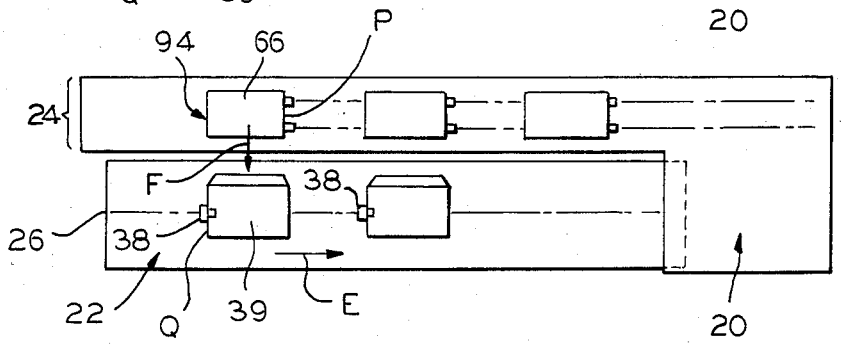

FIGS. 3A and 3B illustrate the adjustment of movable table 22 to align the inserts and the envelopes into which the inserts are to be stuffed. In FIG. 3A, a series of inserts 94 are to be stuffed into a corresponding envelope 96. As inserts 66 move in the direction shown by the arrow F, they are ultimately deposited at stuffing station 66, and pushers 60 drop below movable table 22. Due to the inherent design of stationary table 20 and chains 24, pushers 60 always urge the trailing edge of the ultimate stack of inserts 94 to a fixed point, designated by the letter P in FIGS. 3A and 3B. Point P remains the same regardless of the length of the inserts 94.

Also, the location of clamps 38 on drive chain 26 does not change, whereby the distance between clamps 38 never changes. Since envelopes 96 are pulled by clamps 38 to a specific and constant point Q relative to movable table 22, the probability exists that inserts 94 and envelopes 96 will not line up when they reach position 66 and stuffing position 39, respectively. When envelopes and inserts of different sizes are processed by the insertion machine, alignment between inserts and envelopes must be achieved before the insertion operation can be successfully accomplished.

To accomplish the necessary alignment between envelopes, the present invention provides for the movable table 22 to be shifted horizontally until the inserts 94 and envelopes 96 are aligned. Table 22 is shifted in a precise flat horizontal plane, and the intermittent and continuous speed driving mechanisms and connections therefore for driving chains 24 and 26 and the other driven elements remain in complete mechanical synchronization, whereby the operational sequence of all moving parts of the insertion device is maintained, regardless of the degree of lateral shift of movable table 22. Thus, when table 22 moves, the timing relationship between chains 24 and 26 and the insert and feeder mechanisms remains the same. Additionally, all other functions of the insertion machine remain in the same relationship as prior to movement of table 22. This important feature of the present invention is accomplished by means of the partially floating drive mechanism described hereinbelow.

As seen by comparing FIGS. 3A and 3B, the above explained alignment problems are solved by adjusting movable table 22 to either the left or the right until the envelopes and inserts are properly aligned with each other. For example, in FIG. 3B, table 22 is shown as having been adjusted to the right by a distance 96, as compared to the position of table 22 in FIG. 3A.

Since the jogging or adjustment dislocates the drive mechanism for the two tables, the invention uses a novel solution that in the preferred embodiment incorporates a parallelogram drive mechanism. A difficulty with a parallelogram linkage is that the height of the parallelogram changes as it moves toward the left or right. Therefore, some means must be provided to compensate for these changes in height without sacrificing the accuracy of the drive movement.

Figures 4A, 4B:
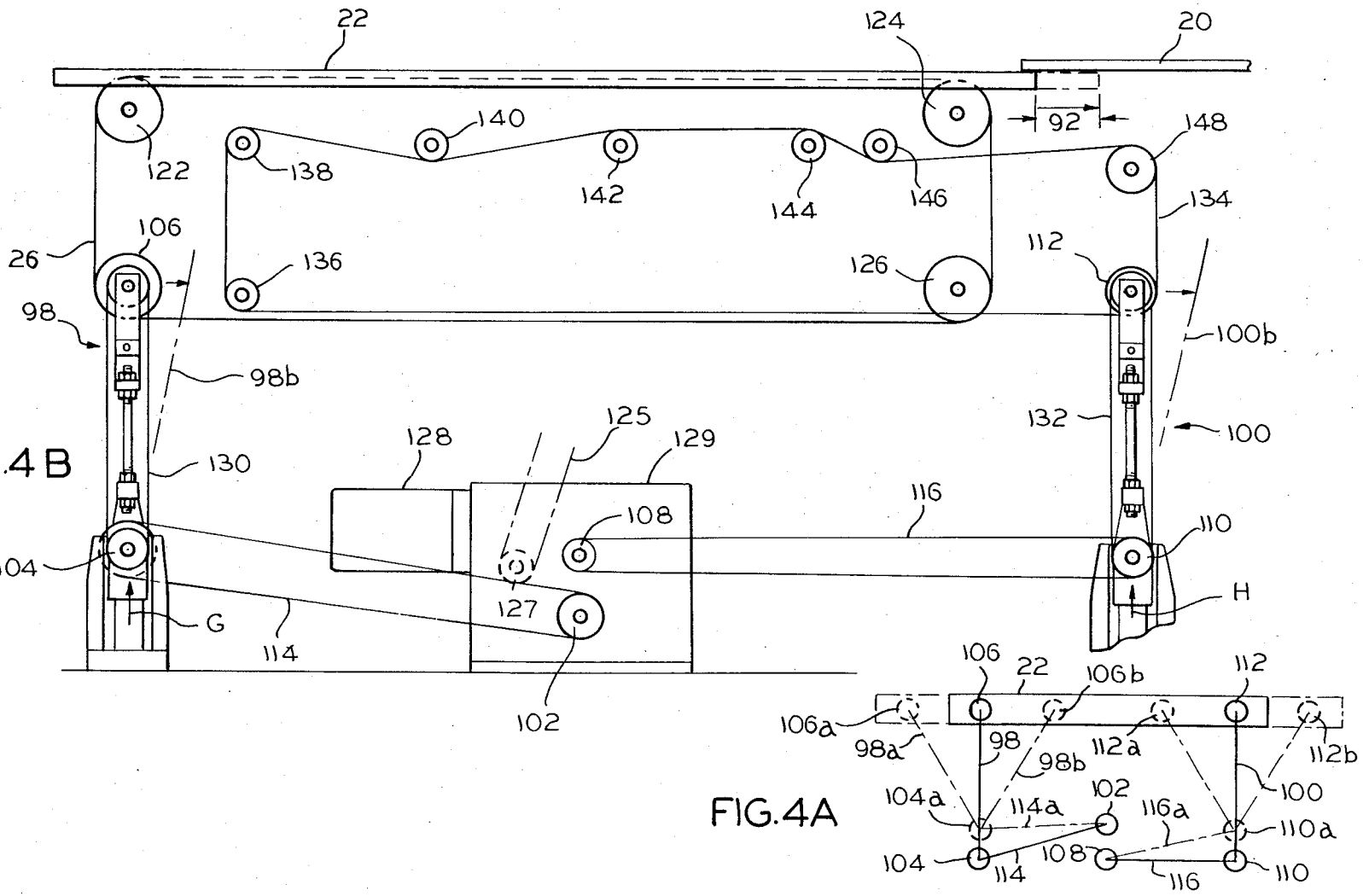
FIG. 4A is a schematical illustration of the principle of the inventive parallelogram drive mechanism.
FIG. 4B is a front elevation of a structure having a drive belt system which incorporates the principles of FIG. 4A and which supplies the power that moves the envelopes and operates mechanisms on the table.

The principle of the inventive parallelogram drive mechanism is explained in schematic form with the help of FIG. 4A, where table 22 is shown in a central position, by solid lines. The adjustment to the left or right positions are shown dot-dashed lines at the opposite ends of the solid lines representing table 22.

The table top 22 (and its associated structures) and the distance between the floor mounted braces supporting the insertion machine represent two spaced parallel horizontal sides of the parallelogram. The two spaced parallel vertical drive links 98, 100 are formed by two drive timing belts or chains which may be driven to supply power to the table 22, in any horizontal position to which table 22 is moved. The motive power to operate the drive timing belts or chains 98, 100 is transmitted from a motor not seen in FIG. 4A through timing pulley or sprocket wheels 102–112. Wheels 106, 112 are attached to and move with the table 22. Wheels 104, 110 float up and down on the inventive support structure. In approximately the center of the bottom side of the parallelogram, wheels 102, 108 are mounted on a gear box which is stationary and does not move.

When the table 22 moves to the left or right, power drive wheels 106, 112 move to positions **106*a*, 112*a* or 106*b*, 112*b*, respectively. Since the length of drive linkages 98, 100 is fixed, wheels 104, 110 are lifted to positions 104*a*, 110*a* by the linkage moving to the left or right linkage positions 98*a*, 98*b*, for example. The positions 106*a*, 106*b*, 112*a*, 112*b* represent the limits of table 22 movement. Of course, movement in some lesser distance may also occur and then drive wheels 104, 110 are lifted by some lesser amount, to positions below 104*a*, 110*a***, respectively.

In a similar manner, the linkages 114, 116 also represent drive belts or chains which move to follow the floating movement of the wheels **104*a*, 110*a*, as indicated by the dot-dashed lines 114*a*, 116*a*. It is obvious that some force urges the wheels 102, 108 to move slightly for the same reasons that the wheels 104, 110 are urged to move upwardly. However, experience shows that, when the proper dimensions are selected for the arms in the parallelogram drive linkage, the forces urging wheels 102, 108 to move become so small that they may be safely ignored. Therefore, wheels 102, 108** are stationary.

From an inspection of FIG. 4A, it should be apparent that the parallelogram movement which changes the vertical height of wheels 104, 110, is distributed between the lever arms 98, 114, 116, 100 by the floating action of the wheels 104, 110 and that a stationary power source may supply power to both the movable table 22 and the stationary table 20 without requiring a complex mechanism.

The practical structure for accomplishing this drive linkage movement is seen in FIG. 4B, where the reference numerals are the same as those used in FIG. 4A. As here shown, the table 22 is about to move over distance 92, toward the right. The vertical drive linkages 98, 100 are indicated as about to swing to the positions **98*b*, 100*b*. Arrows G and H indicate that floating wheels 104, 110 move upwardly as the parallelogram drive linkage swings. The envelope belt or chain 26 is trained around wheels 106, 122, 124, 126 which are mounted on and move with table 22. Therefore, any movement of table 22 has no effect upon the tension of chain 26**.

Gear box 129 is stationary with wheels 102, 108 on one side furnishing motive power through belts 114, 116 to the moving table 22 and a wheel 127 on the opposite side furnishing motive power through belt 125 to the stationary table 20. As a motor 128 drives wheel 104 via gear box 129, belt or chain drive 114, a second belt 130 drives wheel 106. The wheel 106 transmits the resulting motive forces through envelope belt or chain 26 to move the envelopes along the table 22. The motive power from the motor 128 is also transmitted through gear box 129 and drive belt 116, wheel 110, and a drive belt 132 to wheel 112. A drive belt 134 is trained around wheels 112 and 136–148, which are also mounted on and move with table 22. Each of the wheels 138–146 is individually associated with a mechanism on the table 22 which operates at sometime during the insertion cycle. For example, some of these wheels may control movement of the table 22, itself. Other of the wheels may operate cams which raise and lower the pivot arm 44 (FIG. 1), control the application of a vacuum at sucker cups 46, and the like. These cams may also control other functions which are not explained herein since they are not necessary for an understanding of the invention.

The gear box 129 is designed to run in either direction, and either continuously or intermittently. Therefore, a rather complex program may be built into the system by a correct selection of gears for box 129 and cams for wheels 138–146. Or, a microprocessor may be programmed to operate the gear box 129 in different ways depending upon a mode of operation that may be selected. Since, everything may be powered from a single source and operated in synchronism via the unique parallelogram drive mechanism, there is a relatively low cost, quiet and efficient operation.

Figure 5:
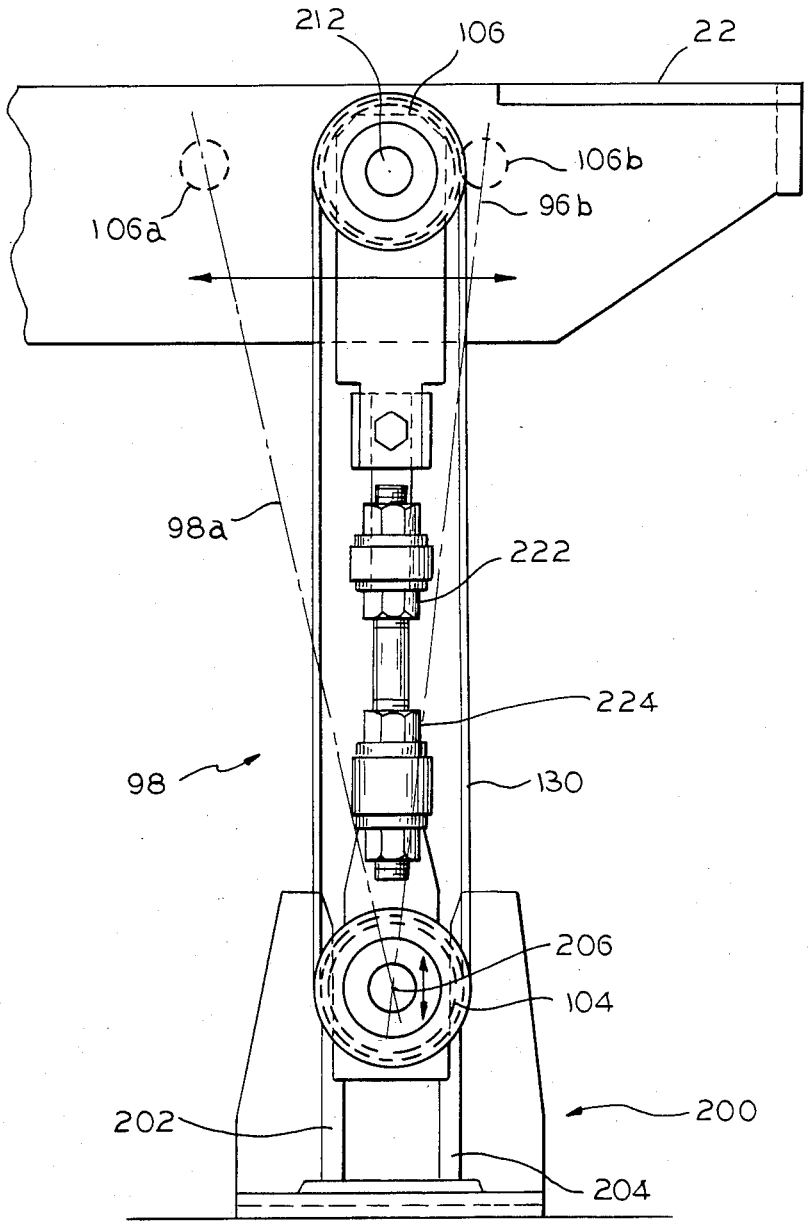
FIG. 5 shows a front elevation of one of a first pair of vertical belt drive linkage which also appears in FIG. 4B.
Figure 6:
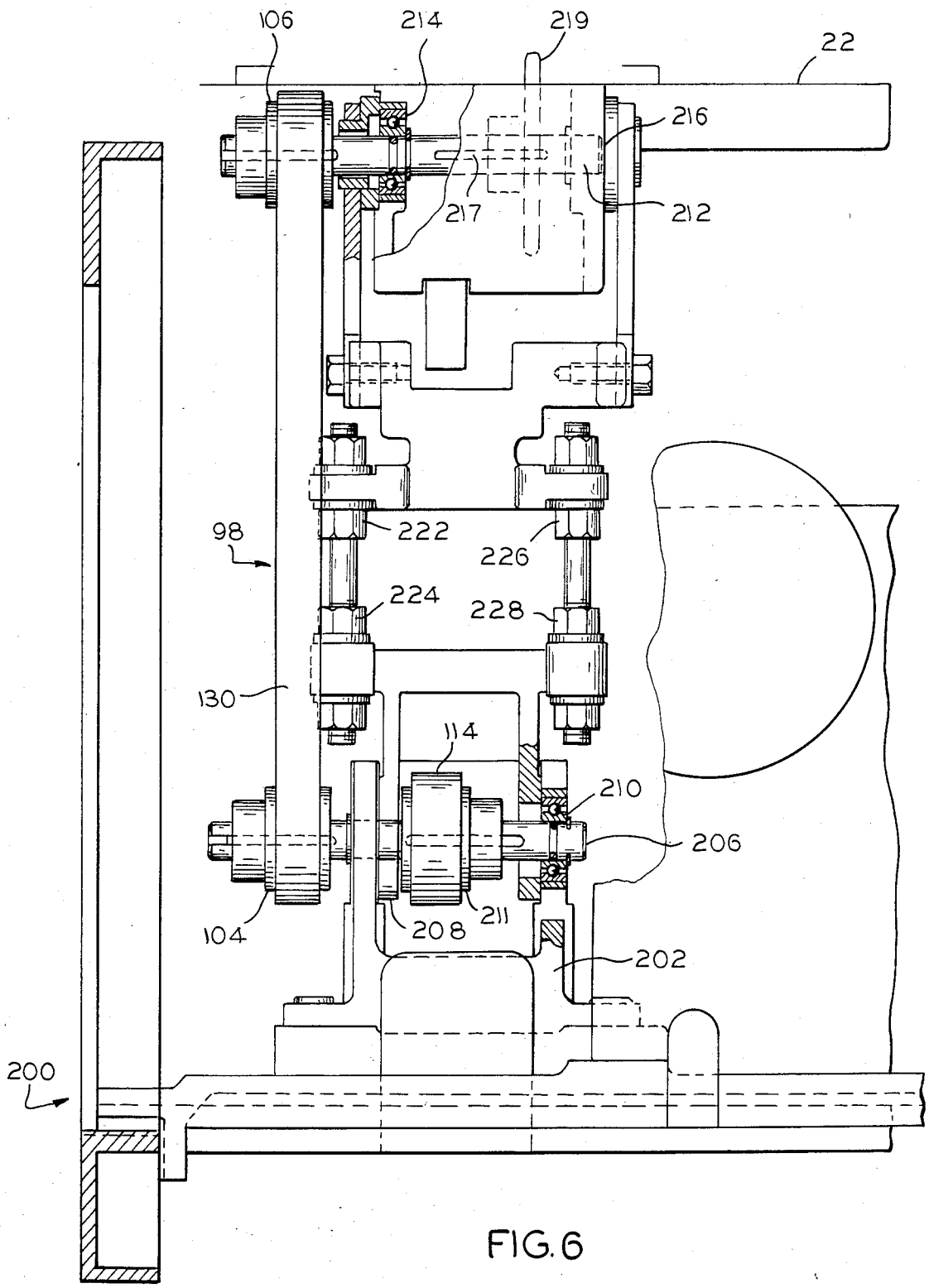
FIG. 6 is a side elevation of the belt drive of FIG. 5.

The mechanical structure of the vertical drive linkage 98 assembly is shown in FIGS. 5, 6. A suitable frame 200 rests on a floor and supports the entire insertion machine. Rising from frame 200 are a pair of vertical rails 202, 204 (FIG. 5) which enable the floating wheel 104 to raise or lower, as indicated by the double ended arrow G, but which restrain the wheel 104 in the direction of table movement. The wheel 104 is mounted on and turns with a shaft 206 which is carried by floating bearings 208, 210 (FIG. 6) riding on the rails 202, 204. Also mounted on and turning with shaft 206 is wheel 211 which carries the belt or chain 114 (FIGS. 4B, 5) leading to the gear box 129. The wheel 106 is carried by and turns with shaft 212 rotating in bearings 214, 216 which are mounted on table 22. A spline at 217 connects a sprocket wheel 219 to shaft 212 for driving envelope chain 26 (FIG. 1). The entire linkage 98 hangs from the table 22 with the bottom end fixed horizontally by rails 202, 204, and completely free and floating in a vertical direction; therefore, the vertical position of shaft 206 and wheels 104, 211, is fixed by the length of linkage 98.

The linkage 98 rigidly interconnects and separates, by a fixed length, the lower bearings 208, 210 and the upper bearings 214, 216. The length of the linkage 98 is established by a pair of vertical shafts having threaded ends. If nuts 222–228 are loosened on these threaded ends, tension is removed and the belt or chain 130 may be replaced. Then, the nuts are tightened to restore proper tension. Since both the length of linkage 98 (FIG. 4A) and the tension of belt 130 (FIGS. 5, 6) are fixed by nuts 222–228, there is no effect upon the tension of belt or chain 130 when wheel 104 floats up or down responsive to table movement. Likewise, since the wheel 219 and other wheels associated with the chain 26 are all mounted on table 22, there is no effect upon the tension in the envelope chain 26, when the table moves. It should now be apparent that the vertical positioning of the floating wheel 104 depends entirely upon the angular position of linkage 98.

In the preferred embodiment, two parallel linkage arms 98, 100 form the vertical members of the parallelogram structure described above. The intermittent drive power is transmitted to the envelope and insert raceways 24, 26 on the moveable and fixed tables, respectively, by means of running belts trained over a series of timing pulleys associated with one of these vertical linkage elements. The coninuous drive power is transmitted to the insert and envelope feed mechanism by means of running belts trained over a series of timing pulleys associated with the other vertical linkage element. In an alternate embodiment, not shown, a single linkage arm having a freely floating lower end and an upper end fixed to the moveable table could suffice, whereby both the intermittently and continuously driven drive systems could be transmitted by a system of timing pulleys and belts associated with a single linkage structured substantially the same as either link 98 or 100.

Additionally, it has been discovered that optinum performance of the present invention is obtained when the length of belt 114 (FIG. 4) is sufficiently long compared to the relatively small vertical movement of the free ends of links 98, 100 when table 22 is moved horizontally whereby the very small difference in the length of belt 14 (since the free ends of links 98, 100 move straight up and down and not in an arc) is compensated for by the inherent slack along the length of belt 114. In this manner, the speed of the continuously and intermittently driven elements remains the same, and they remain in synchronization throughout the full range of movement of table 22.

An advantage of the inventon is that a single power unit may supply power to both a moving table and a stationary table. All belts may be rubber or a rubberized fabric, some with involute teeth to provide a timing function. Therefore, a very quiet operation may be achieved.

Those who are skilled in the art will readily perceive how to modify the system. Therefore, the appended claims are to be construed to cover all equivalent structures which fall within the true scope and spirit of the invention.

The invention claimed is:

1. A common power drive for a stationary device and for a moveable device adapted to move back and forth over a fixed excursion relative to the stationary device, said common power drive comprising a stationary means having at least one rotary power output means, a parallelogram drive means operated responsive to power delivered by said power output means, said moveable device comprising one side of said parallelogram, a pair of spaced parallel drive linkages of fixed length connected to opposite ends of said moveable device, each of said spaced parallel linkages having a free end, means for restraining said free ends of said linkages in the directions of said movement of said moveable device while enabling a free floating in a direction which extends angularly relative to said movement, and means for delivering power from said power output means to the free ends of said spaced parallel linkages; wherein said power drive is part of an insertion machine, said stationary device includes at least one means for delivering inserts to a stuffing position and said moveable device comprising means for delivering envelopes opposite said inserts at said stuffing position, said excursion of said moveable device providing means for aligning the inserts and envelopes at said stuffing position; wherein each of said drive linkages comprises an elongated mechanical link of fixed length having a rotating wheel on each of the opposite ends of said link, a running belt trained over each of the wheels on said link, and a pair of running belts extending from said output means to a wheel on said free ends of an individually associated one of said links, whereby the excursions of said moveable device are distributed over four running belts associated with said pair of spaced parallel drive linkages and said output power means.

2. A single power drive for an insertion machine which includes a stationary device and a reciprocally moveable device, said power drive comprising:

first and second drive linkages driven by a power output means and secured to said moveable device;

said power drive synchronously driving all moving parts of said stationary and moveable devices;

said linkages automatically adjusting their geometric configuration according to a position of said moveable device;

each of said linkages having a fixed length element with its free end reciprocally and linearly moveable regardless of direction of displacement of said moveable device.

3. The power drive of claim 2 wherein each of said free ends include a wheel, each of said drive linkages comprises a running belt trained over said wheels, and said means for delivering power to said free ends comprise a pair of running belts extending from said power output means to one of said wheels on the free end of an individually associated one of said linkages, whereby the excursions of said movable device are distributed over four running belts associated with said pair of spaced drive linkages and said output power means.

4. The power drive of claim 2 wherein said power drive is part of an insertion machine, said stationary device includes at least one means for delivering inserts to a stuffing position and said movable device comprising means for delivering envelopes opposite said inserts at said stuffing position, said excursion of said movable device providing means for aligning the inserts and envelopes at said stuffing position.

5. The power drive of claim 2, and means for delivering power from said output means to said stationary device;

said drive linkages being parallel to each other and each forming a parallelogram like configuration.

6. The power drive of claim 4 and running belt means mounted on and moving with said movable device, and means responsive to the rotation of the wheels on the ends of said links opposite said free ends for driving said belts mounted on said movable device.

7. The power drive of claim 6 and means responsive to a first of said belt means mounted on said moving device for transporting said envelopes to said stuffing positions.

8. A common power drive for a stationary device and for a moveable device adapted to move back and forth over a fixed excursion relative to the stationary device, said common power drive comprising a stationary means having at least one rotary power output means, a parallelogram drive means operated responsive to power delivered by said power output means, said moveable device comprising one side of said parallelogram, a pair of spaced parallel drive linkages of fixed length connected to opposite ends of said moveable device, each of said spaced parallel linkages having a free end, means for restraining said free ends of said linkages in the directions of said movement of said moveable device while enabling a free floating in a direction which extends angularly relative to said movement, and means for delivering power from said power output means to the free ends of said spaced parallel linkages; wherein said power drive is part of an insertion machine, said stationary device includes at least one means for delivering inserts to a stuffing position and said moveable device comprising means for delivering envelopes opposite said inserts at said stuffing position, said excursion of said moveable device providing means for aligning the inserts and envelopes at said stuffing position; running belt means mounted on and moving with said moveable device, and means responsive to the rotation of the wheels on the ends of said links opposite said free ends for driving said belts mounted on said moveable device; means responsive to a first of said belt means mounted on said moving device for transporting said envelopes to said stuffing position; and control means for at least partially controlling the insertion of said inserts into said envelopes at said stuffing position, and means responsive to a second of said belt means mounted on said moving device for operating said control means.

9. A parallelogram drive means comprising a first spaced parallel pair of sides with a second pair of drive linkages extending in parallel therebetween, said second pair of linkages hanging freely from opposite ends of a first of said pair of sides, each of said drive linkages comprising a mechanical link of fixed length having a wheel on each of its opposite ends with a running belt trained around the wheels on said opposite ends, means at the free ends of said hanging links for restraining movement of the wheel in the direction of said pair of sides while enabling a free floating movement in a direction perpendicular to said first pair of sides, and stationary means comprising a pair of oppositely directed drive belts of the side opposite said first side of said parallelogram for driving the wheels having said floating movement.

10. The parallelogram drive of claim 9 and means at said first of said sides for delivering power along the length of said first side responsive to the running belt on said drive linkage.

11. The parallelogram drive of claim 10 and means associated with each of said links for adjusting the tension in the running belts associated therewith.

12. A power mechanism for synchronously delivering power from a plurality of power sources to a plurality of driven means disposed on a moveable support device, said moveable support device adapted to move horizontally relative to a stationary support device, said moveable and fixed support device supported by a fixed base, said moveable support device including linkage means to deliver power from said power sources to certain of said driven means, said linkage means including a first pivoted connection to said moveable support device and a second floating vertically moveable pivotal connection to said base, means for restraining horizontal movement of said second vertically moveable pivotal connection while simultaneously permitting vertical movement of said second floating vertically moveable pivotal connection as said moveable support device moves horizontally.

13. The power mechanism of claim 12 wherein said linkage means further includes wheels over which running belts are trained, said running belts extending from said power source to said driven means on said moveable support device to operate said driven means.

14. The power mechanism of claim 12 wherein said linkage means includes a first set of wheels rotatably connected to said second floating vertically moveable pivotal connection, and a second set of wheels rotatably connected to said first pivoted connection, a first running belt extending between one of said power sources to one of said first set of wheels, a second running belt extending between the other of said first set of wheels to one of said second set of wheels, and a third running belt extending between the other of said second set of wheels and the driven means supported by said moveable support device, whereby said driven means supported by said moveable support device is driven by said one power source through said first, second and third running belts such that horizontal movement of said moveable support device causes said floating vertically moveable pivotal connection to move vertically without changing the length between said first set of wheels and said second set of wheels, thereby preventing any change in speed of the power delivered to said driven means supported by said moveable support device.

15. The power mechanism of claim 14 wherein the distance between said one power source and said first set of wheels is relatively greater than the vertical distance traversed by said first set of wheels and said floating vertically moveable pivotal connection when said moveable support device moves horizontally, whereby the speed of rotation of said first set of wheels remains constant as the inherent slack in said first running belt compensates for the resulting slight change in distance between said one power source and said first set of wheels.

16. A document inserter for inserting an insert document into an envelope at a stuffing station comprising, in combination:

a frame, a horizontal stationary rear table attached to the frame, said table having at least one insert hopper for holding a stack of inserts, an intermittently-driven insert raceway for sequentially moving inserts to the stuffing station, and continuously-driven insert feeder means for feeding inserts onto said insert raceway, a horizontally-adjustable front table, the front table having an envelope hopper for holding a stack of envelopes, an intermittently-driven envelope raceway for sequentially moving envelopes to the stuffing station, and continuously-driven envelope feeder means for feeding the envelopes to the envelope raceway, means for supporting the front table parallel to the rear table and for permitting movement of that front table in a direction parallel to the envelope raceway, a source of continuous power, means connected to the source of continuous power for supplying a source of intermittent power which is synchronous to the source of continuous power, means for synchronously connecting the means for supplying a source of intermittent power to the insert raceway, means for synchronously connecting the source of contiuous power to the insert feeder means, a first drive linkage of fixed length having one free end and having its other end pivotally connected to the front table, means for horizontally restraining the free end of the first drive linkage while enabling vertical and pivotal movement of that free end, means for synchronously connecting the means for supplying a source of intermittent power to the intermittently-driven envelope raceway through the first drive linkage, a second drive linkage of fixed length having one free end and having its other end pivotally connected to the front table, means for horizontally restraining the free end of the second drive linkage while enabling vertical and pivotal movement of that free end, and means for synchronously connecting the source of continuous power to the continuously-driven envelope feeder means through the second drive linkage.

17. A document inserter for inserting an insert document into an envelope at a stuffing station comprising, in combination:

a frame, a horizontal stationary rear table attached to the frame, said table having at least one insert hopper for holding a stack of inserts, an insert raceway for sequentially moving inserts to the stuffing station, and continuously-driven insert feeder means for feeding inserts onto the insert raceway, a horizontal front table, the front table having an envelope hopper for holding a stack of envelopes, an envelope raceway for sequentially moving envelopes to the stuffing station, and continuously-driven envelope feeder means for feeding the envelopes to the envelope raceway, means for supporting the front table parallel to the rear table and for permitting horizontal movement of that front table in a direction parallel to the envelope raceway, a source of continuous power, means for synchronously connecting the source of continuous power to the insert feeder means, a drive linkage of fixed length having one free end and having its other end pivotally connected to the front table, means for horizontally restraining the free end of the drive linkage while enabling vertical and pivotal movement of that free end, and means for synchronously connecting the source of continuous power to the continuously-driven envelope feeder means through the drive linkage.

18. A document inserter for inserting an insert document into an envelope at a stuffing station comprising, in combination:

a frame, a horizontal stationary rear table attached to the frame, said table having at least one insert hopper for holding a stack of inserts, an intermittently-driven insert raceway for sequentially moving inserts to the stuffing station, and insert feeder means for feeding inserts onto the insert raceway, a horizontal front table, the front table having an envelope hopper for holding a stack of envelopes, an intermittently-driven envelope raceway for sequentially moving envelopes to the stuffing station, and envelope feeder means for feeding the envelopes to the envelope raceway, means for supporting the front table parallel to the rear table and for permitting horizontal movement of that front table in a direction parallel to the envelope raceway, a source of intermittent power, means for synchronously connecting the source of intermittent power to the insert raceway, a drive linkage of fixed length having one free end and having its other end pivotally connected to the front table, means for horizontally restraining the free end of the drive linkage while enabling vertical and pivotal movement of that free end, and means for synchronously connecting the source of intermittent power to the intermittently-driven envelope raceway through the first drive linkage.

19. In a document inserter for inserting an insert document into an envelope at a stuffing station, the inserter having a frame; a horizontal stationary rear table attached to the frame, said table having at least one insert hopper for holding a stack of inserts, an intermittently-driven insert raceway for sequentially moving inserts to the stuffing station, and continuously-driven insert feeder means for feeding inserts onto the insert raceway; a horizontal front table, the front table having an envelope hopper for holding a stack of envelopes, an intermittently-driven envelope raceway for sequentially moving envelopes to the stuffing station, and continuously-driven envelope feeder means for feeding the envelopes to the envelope raceway; means for supporting the front table parallel to the rear table and for permitting horizontal movement of that front table in a direction parallel to the envelope raceway; a source of intermittent power; a source of continuous power; means for synchronously connecting the source of intermittent power to the insert raceway; means for synchronously connecting the source of continuous power to the insert feeder means; and an improved means for driving the envelope raceway and envelope feeder, wherein the improvement comprises;

a drive linkage of fixed length having one free end and having its other end pivotally connected to the front table, means for horizontally restraining the free end of the first drive linkage while enabling vertical and pivotal movement of said free end, the length of the first drive linkage selected so that the horizontal movement of the front table causes relatively small vertical movement in the free end of the first drive linkage, means for synchronously connecting the source of intermittent power to the intermittently-driven envelope raceway, and the source of continuous power to the continuously-driven envelope feeder means through the first drive linkage.

20. The document inserter of claim 19 including a second drive linkage of fixed length having one free end and having its other end pivotally connected to the front table, means for horizontally restraining the free end of said second drive linkage while enabling vertical and pivotal movement of said free end of said second drive linkage, the length of said second drive linkage selected so that the horizontal movement of the front table causes relatively small vertical movement in the free end of the second drive linkage, means for synchronously connecting the source of intermittent power to the intermittently-driven envelope raceway through said first drive linkage, and means for synchronously connecting the source of continuous power to the continuously-driven envelope feeder means through said second drive linkage.

21. In a document inserter for inserting an insert document into an envelope at a stuffing station having a frame; a horizontal stationary rear table attached to the frame, said table having at least one insert hopper for holding a stack of inserts, an intermittently-driven insert raceway for sequentially moving inserts to the stuffing station, and continuously-driven insert feeder means for feeding inserts onto the insert raceway; a horizontal front table, the front table having an envelope hopper for holding a stack of envelopes, an intermittently-driven envelope raceway for sequentially moving envelopes to the stuffing station, and continuously-driven envelope feeder means for feeding the envelopes to the envelope raceway; means for supporting the front table parallel to the rear table and for permitting horizontal movement of that front table in a direction parallel to the envelope raceway; a source of continuous power; means connected to the source of continuous power for supplying a source of intermittent power which is synchronized to the source of continuous power; means for synchronously connecting the means for supplying a source of intermittent power to the insert raceway; means for synchronously connecting the source of continuous power to the insert feeder means; and an improved driving means for supplying continuous and intermittent power to the front table, wherein the improvement comprises:

a first linkage of fixed length having one free end and having one restrained end, the restrained end pivotally connected to the front table, the first linkage having a first pair of connected first and second timing pulleys at its free end and having a second pair of connected first and second timing pulleys at its restrained end, a first timing belt connected between the first timing pulley of the first pair of connected pulleys of the first linkage and between the first timing pulleys of the first linkage and between the first timing pulley of the second pair of connected pulleys of the first linkage, means for horizontally restraining the free end of the first linkage while enabling vertical and pivotal movement of that free end, the length of the first linkage selected so that the horizontal movement of the front table causes relatively small vertical movement in the free end of the first linkage, a second timing belt for synchronously connecting the source of intermittent power to the second pulley of the first pair of connected pulleys of the first linkage, a third timing belt for synchronously connecting the second pulley of the second pair of pulleys of the first linkage to the envelope raceway, a second linkage of fixed length having one free end and having one restrained end, the restrained end pivotally connected to the front table, the second linkage having a first pair of connected first and second timing pulleys at its free end and having a second pair of connected first and second timing pulleys at its restrained end, a fourth timing belt connected between the first timing pulley of the first pair of connected pulleys of the second linkage and between the first timing pulley of the second pair of connected pulleys of the second linkage, means for horizontally restraining the free end of the second linkage while enabling vertical and pivotal movement of that free end, the length of the second linkage selected so that the horizontal movement of the front table causes relatively small vertical movement in the free end of the second linkage, a fifth timing belt for synchronously connecting the source of continuous power to the second pulley of the first pair of connected pulleys of the second linkage, and a sixth timing belt for synchronously connecting the second pulley of the second pair of pulleys of the second linkage to the envelope feeder.

22. The document inserter of claim 21 wherein said fifth and sixth timing belts are sufficiently long whereby the relatively small movement of the free ends of the first and second linkages upon horizontal movement of said front table is compensated for by the inherent slack in said fifth and sixth timing belts and the synchronous relationship between said intermittently driven insert raceway and envelope raceway and said insert feeder and envelope feeder is maintained throughout horizontal adjustment of said front table.

* * * * *

UNITED STATES PATENT AND TRADEMARK OFFICE

CERTIFICATE OF CORRECTION

PATENT NO. : 4,604,849

DATED : Aug. 12, 1986

INVENTOR(S) : Edward H. Zemke, Kenneth L. Guenther, Gerald D. Warden.

It is certified that error appears in the above—identified patent and that said Letters Patent is hereby corrected as shown below:

Col. 2, Line 67, change "everytime" to --every time--.

Col. 3, Line 19, insert --to-- between "adjacent" and "stuffing".

Col. 5, Line 42, insert --by-- after "shown".

Col. 6, Line 67, delete "," after "Since".

Col. 7, Line 38, delete "," between "26" and "when".

Col. 7, Line 61, change "optinum" to --optimum--.

Signed and Sealed this

Second Day of December, 1986

*Attest:*

DONALD J. QUIGG

*Attesting Officer*

*Commissioner of Patents and Trademarks*